United States Patent [19]

Beard

[11] 4,086,776

[45] May 2, 1978

[54] LOCK MEANS FOR A TENSION LINE

[75] Inventor: Robert M. Beard, Long Beach, Calif.

[73] Assignee: Compagnie Francaise Des Petroles, Paris, France

[21] Appl. No.: 786,220

[22] Filed: Apr. 11, 1977

[51] Int. Cl.[2] ..... E21B 15/02; E21B 33/035

[52] U.S. Cl. ..... 61/69 R; 61/63; 61/86; 166/.6; 114/258; 175/7

[58] Field of Search ..... 61/69 R, 69 F, 63, 86–104, 61/114; 166/.6; 175/7–9; 114/258, 259, 264

[56] References Cited

U.S. PATENT DOCUMENTS

| | | | |
|---|---|---|---|
| 3,115,933 | 12/1963 | Haeber | 166/.6 |
| 3,163,222 | 12/1964 | Foster et al. | 166/.6 |
| 3,955,623 | 5/1976 | Aumann | 166/.6 |
| 3,987,741 | 10/1976 | Tryon | 61/69 R |
| 4,024,718 | 5/1977 | Roche et al. | 61/69 R |

*Primary Examiner*—Dennis L. Taylor
*Attorney, Agent, or Firm*—Poms, Smith, Lande & Glenny

[57] ABSTRACT

A lock means for one end of a tension line for securing said tension line to a subsea installation and particularly for securing one end of an umbilical line carrying hydraulical and electrical control circuits to a subsea installation. A lock means cooperable with a guide and locking cylindrical member secured to the subsea installation, the cylindrical member having a lock dog receiving recess, and a cylindrical locking device receivable within the cylindrical member and secured to the end of the tension line. The locking device includes a cylindrical housing having a lock dog port and a cylindrical chamber, an elongated annular or sleeve-like piston member within the housing and longitudinally slidable relative to the tension line. The piston member includes a cam surface to slidably engage lock dogs for lateral movement thereof through the lock dog port into locking engagement with the lock recess, a piston portion cooperable with a cylindrical chamber for unlocking said device under fluid pressure, and a piston extension having an upper end exposed through a window for mechanically unlocking the locking device. The piston member is normally biased into locked position by spring means, the locking device being normally non-releasing.

8 Claims, 7 Drawing Figures

LOCK MEANS FOR A TENSION LINE

BACKGROUND OF INVENTION

In subsea offshore well operations, a subsea installation may include hydraulically and also electrically controlled equipment, such as valves which are remotely operated from a platform structure located at the surface of the ocean. Hydraulic and electrical control lines extending from the platform to the subsea installation are desired to be releasably connected to the subsea installation so that if the platform must move to another location or be released from its connection to the subsea station, such release may be readily made. In some instances, such a control line has been associated with tension line means integral therewith so that the line, sometimes called an umbilical line, may be locked at its lower end to the subsea installation.

An example of such an umbilical line construction is shown in my copending application Ser. No. 771,799 owned by a common assignee wherein the umbilical line extends from the subsea installation to a buoyant structure located about 300 feet below the sea surface and the umbilical line continues above the buoyant structure to a floating platform. The buoyant structure is connected with a marine riser system having a lower riser portion and an upper riser portion so that the upper riser portion and the upper portion of the umbilical line can be disconnected at the buoyant structure and the floating platform moved to another location upon such disengagement. The buoyant structure and the lower riser portion are free-standing to permit reengagement of the upper riser portion at a later time. It is desirable that the buoyant structure be securely tethered to the subsea installation so that in the event the lower riser portion should break, the buoyant structure, which exerts an upward tension on the lower riser portion, will not be suddenly released and rapidly travel to the surface and perhaps strike and cause damage to the floating platform normally thereabove.

In prior proposed locking systems for guide line connectors for use in such installations, manually operated locking devices were maintained in locked position by mechanical springs and were unlocked by use of a submarine or by use of go devil means.

SUMMARY OF INVENTION

The present invention relates to a terminal locking device for a tension line or an umbilical line for use at a subsea installation. The invention particularly relates to a locking device for a tension line for releasably securing one end of the tension line to a subsea installation.

An object of the invention is to provide a novel lock means for connecting an umbilical line to a subsea installation and adapted to be remotely disconnected by control means at a remote station.

An object of the invention is to provide a tension line termination lock means, which is normally nonreleasing and which is releasable by hydraulic control means or by mechanical means carried by a subsea vessel.

Another object of the invention is to provide a lock means for a tension line of novel construction wherein means are provided for mechanically unlocking the locking device in the event of a hydraulic pressure fluid failure.

A still further object of the present invention is to provide a locking device for an end of a tension line constructed and arranged to accept relatively large tension loads.

A still further object of the present invention is to provide a locking device for an umbilical line constructed to accept relatively large tension loads and wherein the locking device includes convenient means for assemblying the locking device with means on a subsea installation whereby the umbilical line is secured to the subsea installation and releasable only upon actuation of an hydraulic control circuit and/or mechanical unlocking means.

Various objects and advantages of the present invention will be readily apparent from the following description of the drawings in which an exemplary embodiment of the invention is shown.

IN THE DRAWINGS

FIG. 1 is a fragmentary view, partly in section, of a subsea installation adapted to be equipped with the termination lock means for this invention.

FIGS. 2*a* and 2*b* are enlarged fragmentary sectional views taken in the vertical plane indicated by line II — II of FIG. 1.

Figure 1:
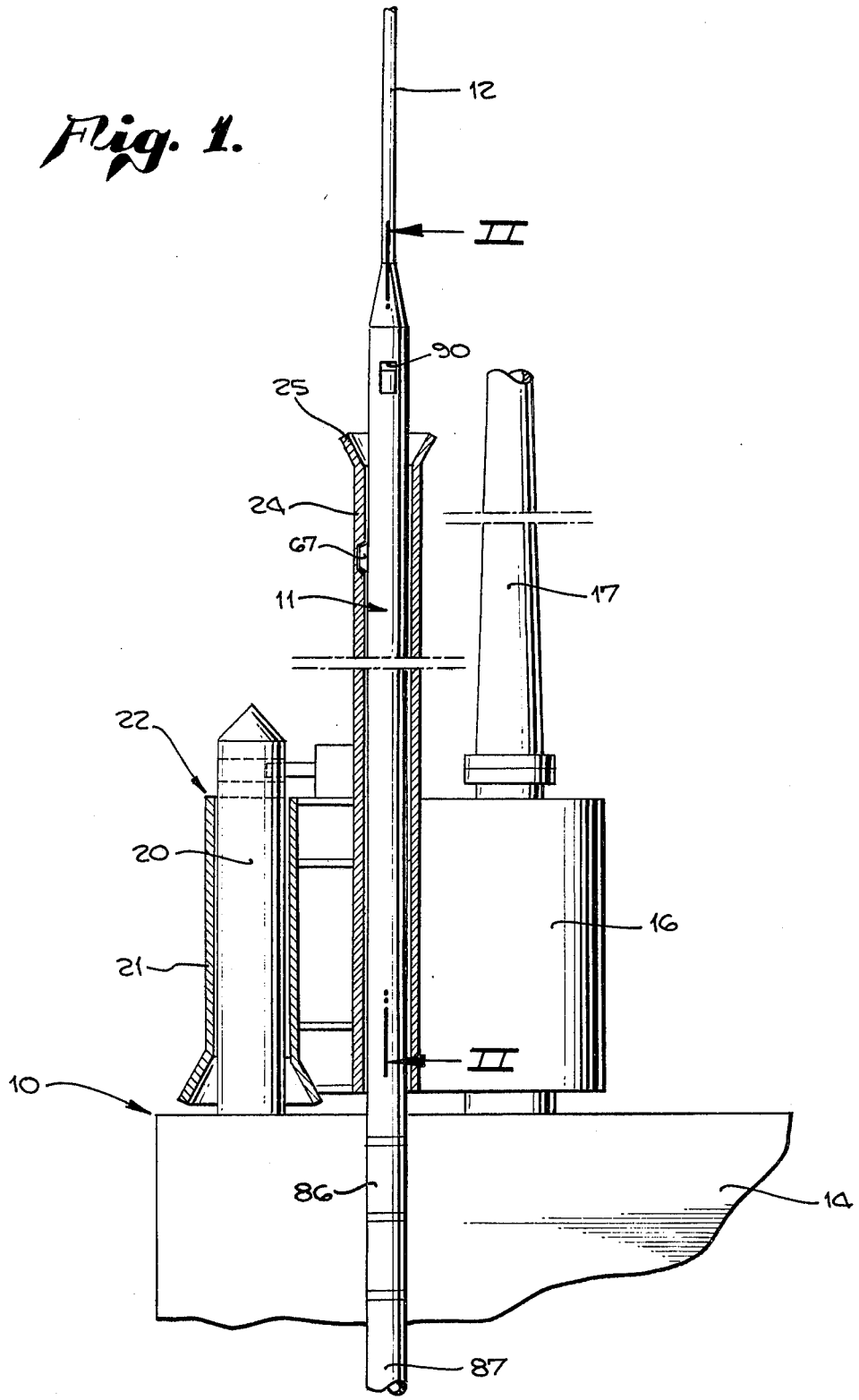

In FIG. 1 there is shown a subsea installation generally indicated at 10 equipped to receive a lock means generally indicated at 11 for a tension line, control line, or umbilical line generally indicated at 12, which extends to the surface for connection to a floating platform, not shown. In this example, subsea installation 10 comprises a base 14 which may be anchored or secured to the sea floor in suitable well-known manner. Anchor base 14 may carry suitable manifold means for receiving flowlines from a plurality of subsea wells and for conducting production fluid from said wells through a marine riser connector 16 connecting a vertically extending riser pipe means 17 which extends to the floating platform.

The fragmentary subsea installation shown in FIG. 1 may be constructed similarly to a subsea installation shown in copending application Ser. No. 771,799 owned by a common assignee. In the copending application, the subsea installation includes an anchor base on the sea floor, a permanent manifold structure equipped with various production and fail-safe valves, a removable manifold structure equipped with production valves and control valves and a lower riser connector structure providing a connection with the upstanding marine riser system. The anchor base, manifold structures and lower riser connector means are interconnected and locked through marine riser connectors so that after installation they are normally inseparable, only the lower riser connector means and the removable manifold structure being separable for service and maintenance when required. In the marine riser system of said copending application, the riser system comprises a lower riser portion connected to a buoyant structure located about 300 feet below the sea surface and an upper riser structure extending to the floating platform. A rapid connect and disconnect means is provided at the buoyant structure so that when the upper riser portion is released therefrom the upper buoyant structure and lower riser portion may be free standing and remain upright until reconnection is made with the upper riser portion. One of the purposes of the umbilical line such as 12 is to serve as a tension or tethering line for the buoyant structure in the event of failure or breakage of the lower riser portion which would then permit the buoyant structure to rapidly rise to the surface and perhaps severely damage the floating platform thereabove. It is the purpose in FIG. 1 to show only a portion of such a subsea base manifold structure which relates to the present invention.

In FIG. 1 the base 14 includes a marine riser connector 16, which is shown connected to the upstanding riser pipe 17. The base 14 also includes a guide post 20, which is received within a guide tube 21 provided on the manifold structure generally indicated at 22. Manifold structure 22 must be lowered into close association with the base 14 and may be fixedly secured thereto through the marine riser connector 16.

Figure 2B:
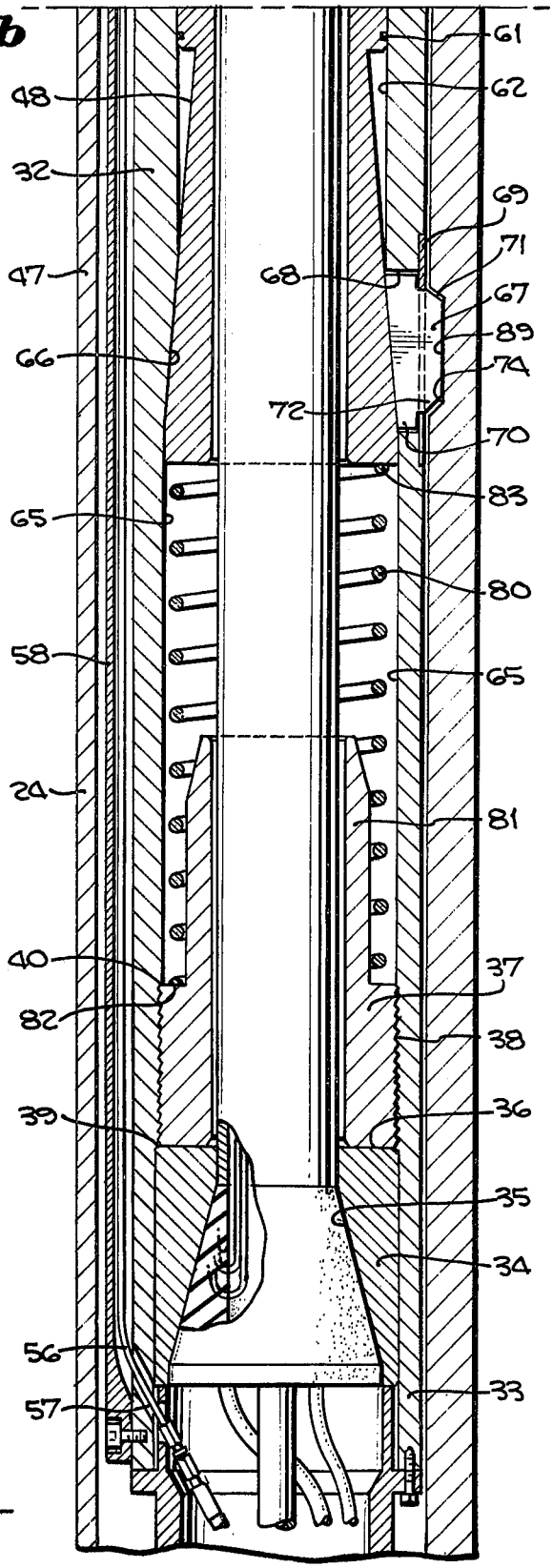
Figure 3:
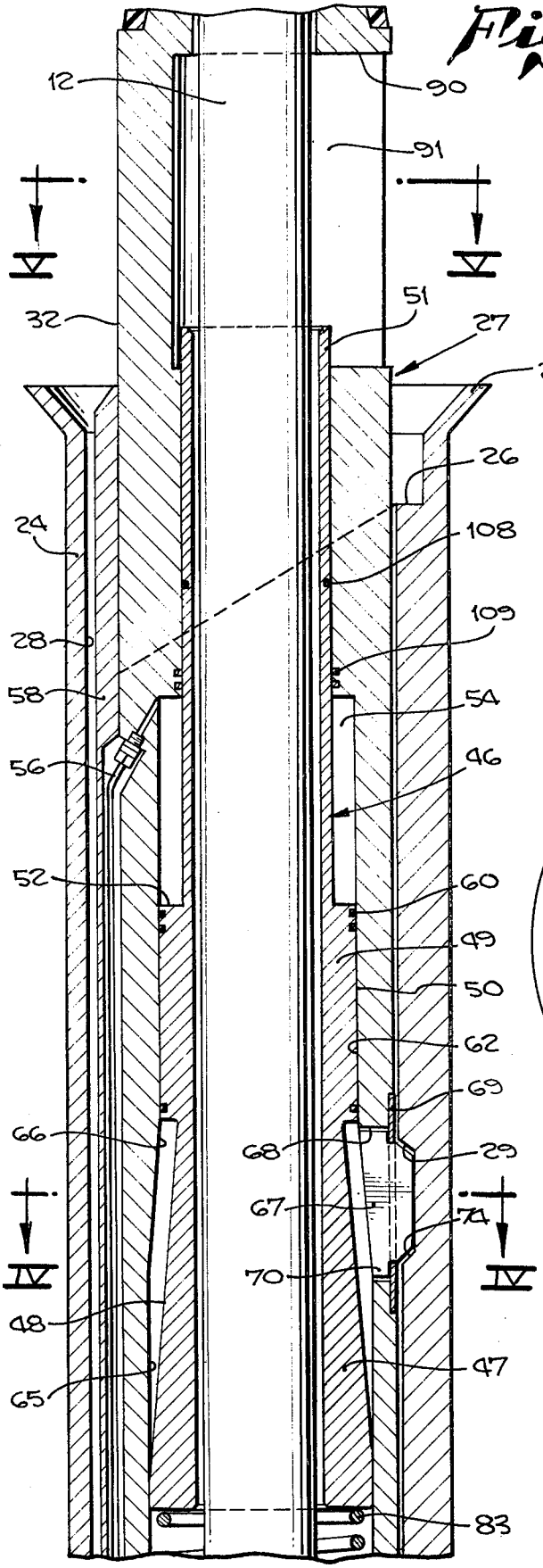
FIG. 3 is an enlarged fragmentary sectional view taken in the same plane as FIG. 2 and showing the lock means in released position.
Figure 4:
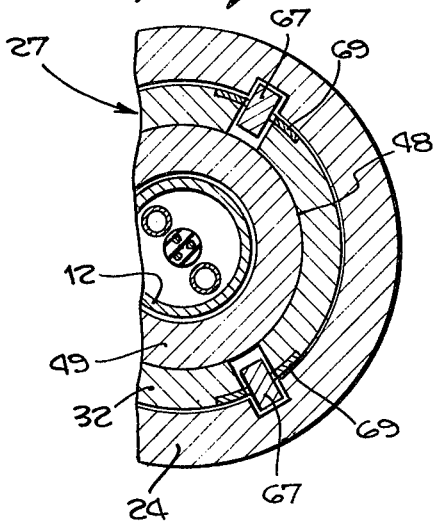
FIG. 4 is a fragmentary transverse sectional view taken in the plane indicated by line IV — IV of FIG. 3.
Figure 5:
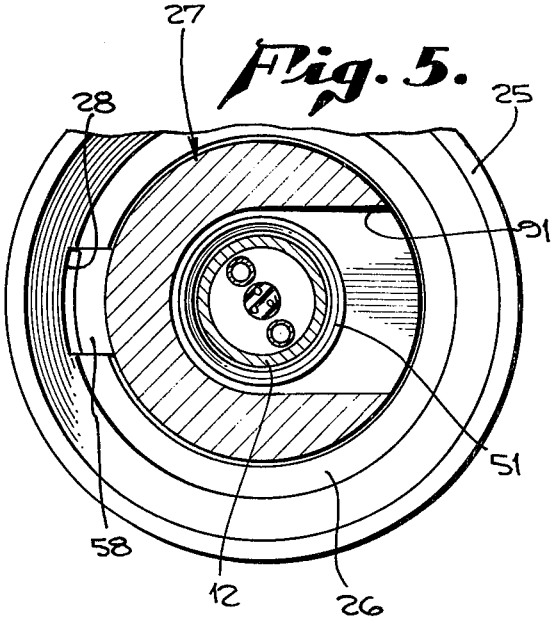
FIG. 5 is a fragmentary transverse sectional view taken in the plane indicated by line V — V of FIG. 3.

The means for terminating and securing in releasable locked relation the lower end of the umbilical or tension line 12 at the manifold structure 22 includes a guide and locking cylinder member 24 extending above the manifold structure 22 and provided with an outwardly flared end 25 to facilitate guiding and reception of the lower end of the tension line 12. Adjacent the top end of cylinder member 24, the internal surface thereof may be provided with a helical ramp 26 serving as an internal guide cam for the locking device generally indicated at 27 carried at the lower end of the umbilical line 12. The cam ramp 26 leads to an axially extending keyway 28 to provide angular orientation of locking device 27 within the cylindrical member 24. Spaced downwardly from the top end of the cylindrical member 24 are provided a plurality of angularly spaced lock dog recesses 29, only one of which is shown in FIG. 2*b* and FIG. 3.

As mentioned above, locking device 27 is carried by the lower end of tension or umbilical line 12. Locking device 27 includes a cylindrical housing 32 provided with an open lower end 33, FIG. 2*b*, within which is seated a socket member 34 having an internal conical surface 35 for reception of tension load lines forming a part of the umbilical line 12. The conical socket chamber may be filled with a suitable epoxy compound in usual manner. The socket member 34 has an upwardly directed annular face 36 which seats against an internal fitting 37 having threaded engagement at 38 with the internal surface of the housing. The threaded portion of the housing provides also a shoulder 39 and a shoulder 40 for transmitting vertical loads to the housing member from the umbilical line 12.

Figure 2A:
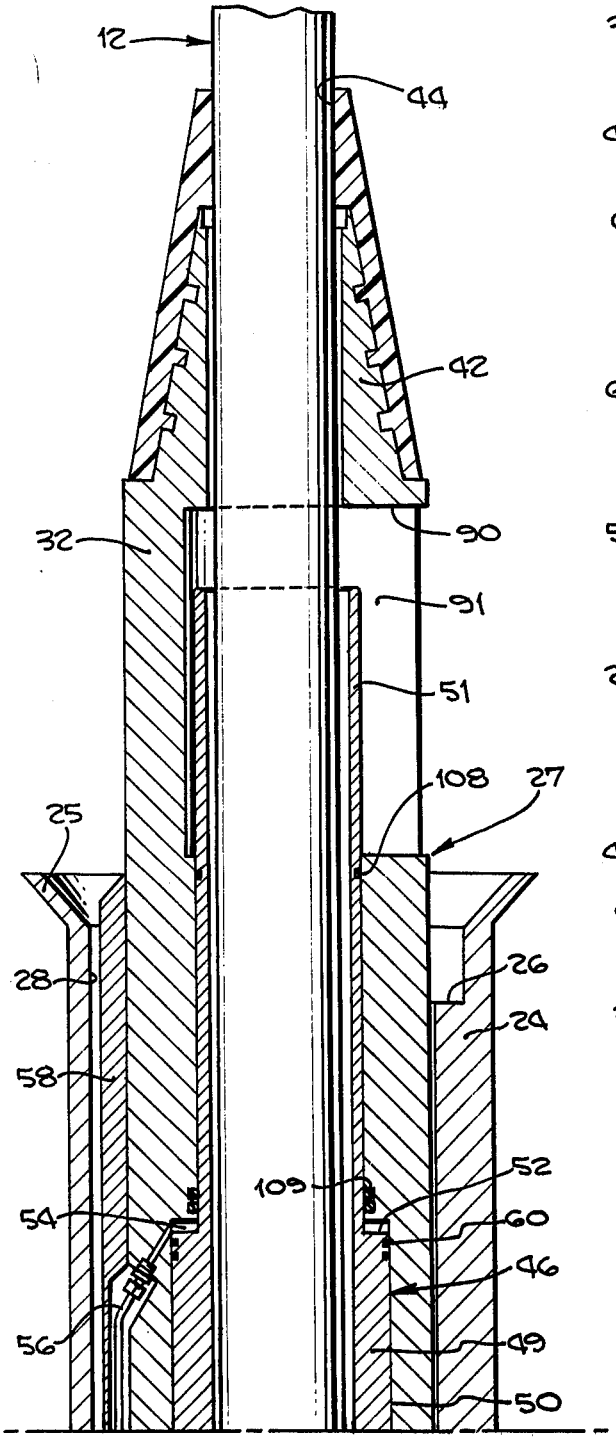

At the top of housing 32, FIG. 2*a*, the upper end of the housing is provided with a conical shaped end 42, which may be covered with a conical shaped boot 43 of polyurethane material providing an opening 44 for the umbilical line 12. Boot 43 extends along umbilical line 12 a selected length to provide means for reducing differentially to zero at the top of end 42 the umbilical bending moment encountered at the junction of line 12 and conical end 42.

Locking device 27 also includes an elongated piston member 46 sleeved over line 12 which is received within the housing 32. Piston 46 is movable longitudinally or axially relative to the housing in the annular space provided between the internal surfaces of housing 32 and umbilical line 12. Piston member 46 is elongated and includes a lower portion 47 having a frusto-conical outer surface 48, a central or intermediate piston portion 49 having a cylindrical surface 50, and an upper cylindrical piston extension 51 having a reduced diameter as compared with the diameter of surface 50 to define a shoulder 52 which provides with an opposing shoulder on the housing 32 a fluid pressure chamber 54.

Fluid chamber 54 is provided communication with an hydraulic unlocking circuit through a tube 56 which extends longitudinally along the outside of housing 32 and reenters the space below socket member 34 as at 57. The tube 56 is covered by a removable elongated cover member 58 which also serves as a key for reception within the keyway 28 provided in the locking cylindrical member 24. The hydraulic control line 56 may be connected to an hydraulic control circuit associated with the floating platform to provide remote control of the unlocking of the locking device.

The central cylindrical piston portion 49 is provided with seals 60 and 109 which slide against the interior surface 62 of the housing to provide a piston chamber.

Lower end portion 47 of piston sleeve member 46 has a relatively long shallow tapered surface 48 which in unlocked position moves into a somewhat enlarged chamber 65 provided above fitting member 37. Internal surfaces of the piston chamber 54, as they extend toward the fitting 37, are also provided with a corresponding tapered surface 66, which limits the upward movement of the piston sleeve member 46 and which are provided diametrically opposite locking dogs 67 so that when the dogs are in locked position, as shown in FIG. 2*b*, the piston sleeve member will be restricted against lateral movement which serves to hold locking dogs 67 in their locking recesses 29.

Locking dogs 67 are carried by housing 32 in lock ports 68 provided therefor. Each lock port 68 has a retainer plate 69 on the external surface of the housing, the retainer plate extending over a shoulder 70 provided on the lock dog to limit radial outwardly directed displacement of dogs 67. Each dog 67 has top and bottom tapered edge portions 71 and 72, which cooperate with corresponding surfaces 73 and 74 on the cylindrical member 24. The back or internal face for each lock dog 67 may be inclined as at 75 to slidably cooperate with the surfaces 48 on the lower end of the piston sleeve member.

Spring means for biasing and forcing the piston sleeve member 46 upwardly and into locked position comprises a coiled spring 80 sleeved over the umbilical line 12 and over a tubular extension 81 on fitting 37. The lower end of spring means 80 is seated on fitting 37 as at 82 and the upper end of spring 80 is seated against the downwardly facing surface of the lower end face of piston sleeve member 36 as at 83.

Fluid pressure means for actuation of the locking device to release the locking dogs and to permit removal of the umbilical line from the manifold base assembly may comprise hydraulic circuit means connected directly to the floating platform. The lower end of the umbilical line 12 may include, below the locking device described above, a hydraulic connecting means schematically indicated at 86 and therebelow an electrical connector means 87.

During installation, lock means 11, together with the control probe hydraulic connecting means 86 and electrical connecting means 87, may be guided into the lock and guiding tube 24 by well-known means. Lock dogs 67 are in retracted position because the chamber 54 is under fluid pressure and piston member 46 is held thereby in unlock position. The lock means 11 is angularly oriented by the internal ramp means 26 and is axially oriented by stop means, not shown, associated with the control probe portions 86 and 87. When the lock means has been axially and longitudinally oriented, the lock dogs 67 are opposite dog recesses 29. Fluid pressure in chamber 54 is released by remote means permitting the piston member 46 to be urged upwardly by spring 80 and causing the lock dogs 67 to be cammed outwardly by tapered surfaces 48 into interlocked relation with the dog recesses 29 in the lock and guide cylinder 24. The lower end of tension line 12 is thus securely retained within lock housing 32 and the guide and locking cylinder member 24. Since cylinder member 24 is secured and fixed to the manifold base means as described above, the weight of the entire base manifold system is available to secure and anchor the tension line 12. The tension force capacity of such a locking system described above is very great, one example of which is 170,000 lbs. of tension.

Lock means 11 may be released from a remote station by hydraulic circuits carried by the umbilical line 12 or by other hydraulic circuit lines to introduce pressure fluid into the chamber 54 through the fluid conducting tube 56. Such fluid pressure pushes the piston member 46 downwardly against the springs 80 to position the cam surfaces 48 so that the lock dogs 67 may be displaced radially inwardly and disengaged from the lock dog recesses 29 on the cylinder member 24.

Under such a hydraulic fluid pressure control system, it will be apparent that in the event there is a failure in the hydraulic pressure fluid control circuit or line controlling the lock piston 46 that the piston member 46 will remain in upper position with the lock dogs 67 interengaged with the lock recesses 29 for retention and securement of the tension line 12.

In such latter case, the hydraulic control circuit may not be readily repairable and it may be desired to release tension line 12 from its securement to the subsea base. Means for mechanically unlocking the locking device 11 includes an elongated window 90 in lock housing 32 located just above the top of guide and cylindrical lock member 24. As best seen in FIGS. 2*a* and 3, the piston extension 51 in locked position of the piston member 46 projects into the space behind the window and into spaced relation as at 91 to the upper conical end 42 of the lock housing 32. Window 90 is accessible for the introduction of a pair of pressure arms 94 and 95 carried by a hydraulically actuated press 96 provided on the nose of a submarine or submersible vessel 97, FIG. 6. The hydraulic press 96 includes a double acting cylinder and piston means 98 whereby pressure fluid introduced through fluid line 99 causes piston member 100 to move downwardly and cause pressure arm 95 to press downwardly against the top edge of the piston sleeve extension 51 as at 101 in order to urge the piston member downwardly to unlock the lock dogs 67. Pressure arms 94 and 95 may include part-circular recesses 102 for embracing line 12 and for providing an arcuate seating at 101 on the top edge of the piston extension by the lower pressure arm 95. The upper pressure arm 94 serves as a fixed arm which may bear against the housing as at 103 for providing a pressure support for the hydraulic device 96. The lower pressure arm 95 connected to piston rod 100 may also be connected to a member 104 pivotally connected at 105 to the nose of the submersible vessel 97.

It should be noted that the window 90 provides access of sea water to the interior of the top part of housing 32. To prevent contamination of the lock means 11 by sea water and other foreign matter, the piston member 46 is provided with seal means 108 and 61 to isolate and protect the sliding interfacial engagement of piston member 46 with chamber walls of cylindrical housing 32 from such sea water and contamination thereby.

Upon release of the locking dogs 67 by the mechanical unlocking hydraulic pressure means 96, the tension line 12 may be withdrawn from the cylindrical member 24.

Figure 6:
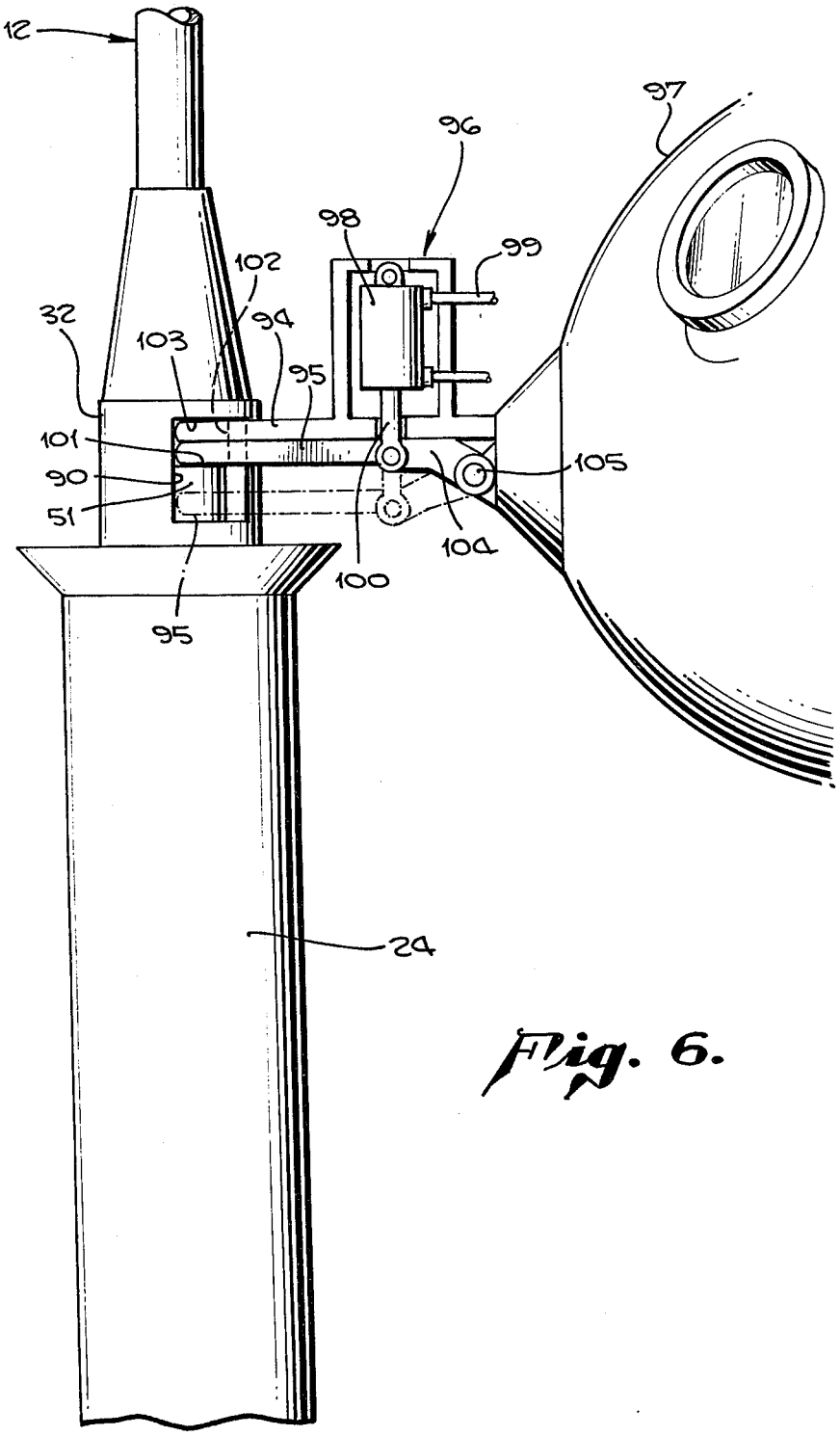
FIG. 6 is a fragmentary elevational view illustrating mechanical release means for the termination lock, the release means being associated with a submarine vessel.

The locking means for terminating a tension line as described above may also be useful in releasably locking umbilical lines, and cables which are maintained under selected tension and which are desired to be nonreleasable, except upon remote control of a pressure fluid circuit or by a mechanical unlock mechanism, such as shown in FIG. 6.

Various modifications and changes may be made in the lock means for a tension line as described above and which come within the spirit of this invention and all such changes and modifications coming within the scope of the appended claims are embraced thereby.

I claim:

1. A lock means for a tension line adapted to have a lower end releasably connected to a subsea installation, including the combination of:
   - an upstanding guide and locking cylindrical member secured to said subsea installation,
   - said cylindrical member having a lock dog receiving recess,
   - an elongated cylindrical locking device receivable within said cylindrical member
   - means securing said locking device to one end of said tension line;
   - said locking device including
   - a cylindrical housing having a lock dog port and a cylindrical chamber;
   - an elongated piston member within said housing and having a cylindrical portion longitudinally slidable in said cylindrical chamber,
   - said piston member having an elongated frusto-conical portion providing a cam surface, a lock dog slidably engagable by said cam surface and laterally movable thereby through said lock dog port into locking engagement with said lock recess;
   - spring means normally biasing said piston member to hold said lock dog in locked position;
   - and fluid pressure means communicating with said cylindrical chamber for moving said piston member to allow the lock dogs to move laterally inwardly into unlocked position.

2. A lock means as stated in claim 1 including
   - means other than said piston moving means to allow said lock dogs to move toward unlocked position.

3. In a lock means as stated in claim 2 wherein
   - said other means includes a window in said cylindrical housing spaced from said cylindrical chamber;
   - and an extension cylinder on said piston member terminating opposite said window and adapted to be engaged by mechanical means through said window.

4. In a connector as stated in claim 2 wherein
   - said other means for unlocking said lock dogs are provided on said cylindrical housing and on said piston member at a location beyond the end of said upstanding guide and locking cylindrical member.

5. In a lock means as stated in claim 4 including protective seal means between said piston member and said cylindrical housing for preventing contamination of the surfaces of said piston member and cylindrical housing above said cylindrical chamber.

6. A lock means as stated in claim 1 including means for allowing said locking dogs to move to unlocked position other than said first piston moving means;

said second means including an axial cylindrical extension on said piston member;

an elongated longitudinally extending window in said cylindrical housing opposite the end of said piston cylindrical extension;

and external remotely actuated force supplying members having ends adapted to be inserted through said window into engagement with the top end of said piston cylindrical extension for exerting a force to axially move said piston member against said biasing means to allow the locking dogs to move inwardly to unlocked position.

7. A lock means for releasably terminating an end of a tension line comprising:

a cylindrical housing adapted to receive said tension line through one end;

means for securing said tension line at the other end of said housing;

an annular piston chamber in said housing defined by an annular shoulder facing and spaced from said tension line securing means;

an annular piston member slidably movable in said annular piston chamber and sleeved over said tension line;

spring means sleeved over said tension line in said cylindrical housing for biasing said piston member in one direction;

a lock dog port in said housing;

a lock dog in said port and having cammed engagement with said piston member;

and pressure actuating fluid in communication with said piston chamber for urging said annular piston member against said biasing spring forces.

8. In a lock means as stated in claim 7 including means at one end of said cylindrical housing for actuating said piston member in the absence of said pressure fluid.

* * * * *